United States Patent [19]

Carraro et al.

[11] Patent Number: 4,715,161

[45] Date of Patent: Dec. 29, 1987

[54] SUSPENDED CEILING GRID CLIP

[75] Inventors: Eugene Carraro, Roslyn Heights, N.Y.; Raymond S. Laughlin, Cuyahoga Falls, Ohio

[73] Assignee: Erico International Corporation, Solon, Ohio

[21] Appl. No.: 864,324

[22] Filed: May 19, 1986

[51] Int. Cl.[4] ..... E04B 5/52

[52] U.S. Cl. ..... 52/714; 52/665; 403/241

[58] Field of Search ..... 52/665, 666, 712, 714, 52/715, 484, 489; 403/230, 251, 346, 347, 217, 241

[56] References Cited

U.S. PATENT DOCUMENTS

| | | | |
|---|---|---|---|
| 3,089,570 | 5/1963 | O'Neil | 52/484 |
| 3,677,589 | 7/1972 | Roles | 52/665 |
| 3,911,638 | 10/1975 | Englund | 52/665 |
| 4,479,341 | 10/1984 | Schuplin | 52/665 |
| 4,583,340 | 4/1986 | Sauer | 52/665 |

FOREIGN PATENT DOCUMENTS

| | | | |
|---|---|---|---|
| 260978 | 10/1961 | Australia | 403/241 |
| 3048946 | 7/1982 | Fed. Rep. of Germany | 52/665 |

*Primary Examiner*—John E. Murtagh

*Attorney, Agent, or Firm*—Renner, Otto, Boisselle & Lyon

[57] ABSTRACT

A spring steel clip for suspended ceiling grids may be used both as an edge molding attachment starter clip and also as a clip for holding intersecting tee bars together with the intersection being horizontally adjustable with simple finger pressure. The one piece clip includes a orizontal portion and a right angle vertical portion. The horizontal portion includes an offset portion with slots in the lower edge of such offset portion to accommodate the bulb of the stem of a tee. When the offset portion is compressed with finger pressure the angle of the slots with respect to the tee change permitting the tee bulb to be inserted or removed or horizotally adjusted. When released the edges of such slots lock against and capture the bulb of the tee. The vertical portion includes a downwardly extending planar tab adapted to fit behind the edge molding and at least one offset tab which includes barbs extending toward the planar tab to capture and retain the hemmed upper edge of the molding. The offset tab also partially blocks access to a restricted notch at the corner of the clip so that a tee stem bulb may be forced into the notch with the offset of the tab snapping beneath the bulb. The vertical portion of the clip may be suspended or secured directly to a wall.

17 Claims, 8 Drawing Figures

SUSPENDED CEILING GRID CLIP

DISCLOSURE

This invention relates generally as indicated to a suspended ceiling grid clip and more particularly to a clip which can be used not only as a molding attachment starter clip but also as a tee bar horizontal control clip.

BACKGROUND OF THE INVENTION

Conventionally fastening systems for suspended ceiling grid systems involve the use of punches or pop rivets or other labor costly techniques. Such system are not readily forgiving of error nor do they permit ready control or horizontal adjustment of connecting tees or moldings at right angles to tees. Moreover, if horizontal movement is not controlled during construction, slippage and failure may occur.

The use of punching and pop riveting in addition to being labor intensive, also results in a marked or unclean exposed surface connection.

Conventionally the starting main tees may be wired tight to the wall through the use of a spalyed first row of hanger wires which are required to maintain position of acoustical suspension systems. Also, temporary clamps are sometimes employed to hold tees to the wall molding. Even then the first row of cross-tees may fall out since there are normally no cross-tee attachment holes in the wall molding. This in turn normally means that the first row of cross-tees have to be measured and cut exactly in the field, rather than being pre-cut or gang cut. This again is a time consuming and labor intensive operation.

Also, rather short lengths of cross-tees are difficult to maintain in proper position and tend to lift off the molding, and when using screw slot grid members, these normally have to be fastened firmly to the wall molding.

SUMMARY OF THE INVENTION

A spring steel clip for suspended ceiling grids is disclosed which may be used both as an edge molding attachment starter clip and also as a clip for holding intersecting tee bars together with the intersection being horizontally adjustable with simple finger pressure. The one piece clip includes a horizontal portion and a right angle vertical portion. The horizontal portion includes an offset portion with slots in the lower edge of such offset portion to accommodate the bulb of the stem of a tee. When the offset portion is compressed with finger pressure the angle of the slots with respect to the tee change permitting the tee bulb to be inserted or removed or horizontally adjusted. When released the edges of such slots lock against and capture the bulb of the tee. The vertical portion includes a downwardly extending planar tab adapted to fit behind the edge molding and at least one offset tab which includes barbs extending toward the planar tab to capture and retain the hemmed upper edge of the molding. The offset tab also partially blocks access to a restricted notch at the corner of the clip so that a tee stem bulb may be forced into the notch with the offset of the tab snapping beneath the bulb. The vertical portion of the clip may be suspended or secured directly to a wall.

The clip not only adjustably grips the various ceiling grid components, but it also can accommodate various size wall moldings and various height and types of cross and main tees.

More importantly, the clip eliminates the punching of holes and pop riveting providing a clean unmarked exposed surface connection. The clip also eliminates the wire tying of the starting main tees to the wall as well as the precision field cut of at least the first row of cross-tees. The clip also prevents the cross-tees from lifting off or slipping or shifting position, while accurately yet adjustably maintaining the position of such cross-tees. The clip further eliminates the problem of firmly attaching screw slot grid members to the wall molding.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE ILLUSTRATED EMBODIMENTS

Figure 1:
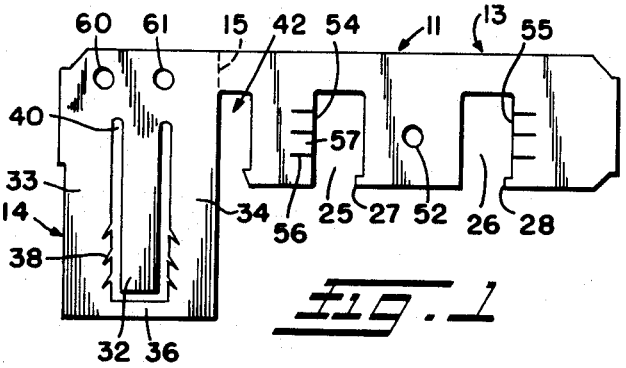
FIG. 1 is a plan view of the blank from which the clip of the present invention is formed.
Figure 5:
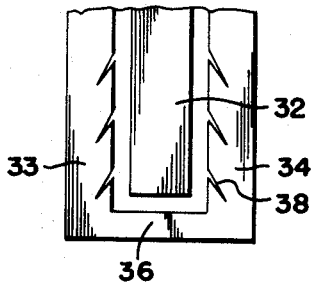
FIG. 5 is an enlarged fragmentary elevation of the lower end of the vertical portion of the clip.
Figure 2:
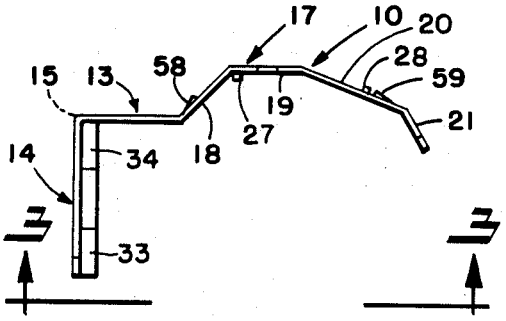
FIG. 2 is a top plan view of the clip after forming.
Figure 3:
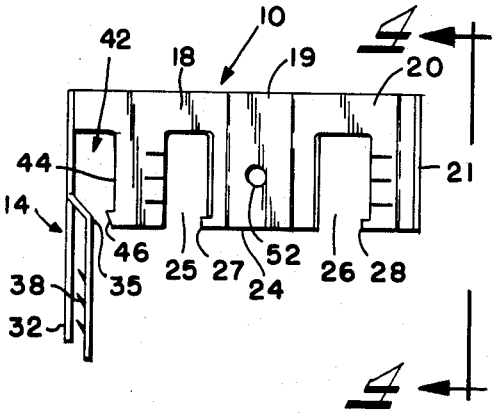
FIG. 3 is a front elevation of the clip after forming as seen from the line 3—3 of FIG. 2.
Figure 4:
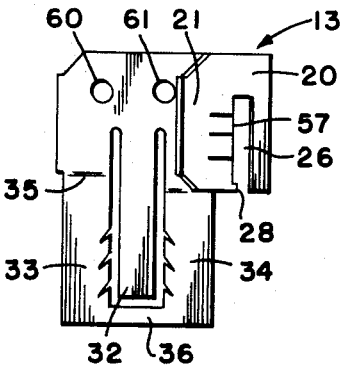
FIG. 4 is an end elevation of the clip as seen from the line 4—of FIG. 3.

Referring first to FIGS. 1–3 there is illustrated in FIGS. 2 and 3 the clip 10 of the present invention and blank 11 in FIG. 1 from which it is formed. The blank 11 may be stamped from sheet metal and then formed through progressive dies into the clip shown in FIGS. 2 and 3. Thereafter the clip is spheroidized and annealed to the requisite hardness and then provided with a phosphate and rust arrest finish.

The clip includes what may be generally termed a horizontal portion or arm 13 and a vertical portion 14 which, when formed, extend at substantially right angles to each other.

Although the entire clip is formed from a single sheet which is in the vertical plane, the clip may nonetheless include the horizontal arm or portion 13 and the vertical portion 14 which is of greater vertical extent. The blank of the clip is essentially bent along a fold line indicated at 15 so that the horizontal portion 13 is at substantially a right angle to the plane of the vertical portion 14.

The horizontal arm portion 13 includes a laterally directed offset indicated at 17 which is in a series of angularly related vertical planes and which includes a deflected portion 18, a portion 19 essentially parallel to the proximal end of the horizontal portion, and a rebent angularly related portion 20 which terminates in a more severely bent terminal tab end 21.

The lower edge 24 of the horizontal portion 13 is provided with generally rectangular notches indicated at 25 and 26 which extent upwardly from such edge in the bent portion 18 and the rebent portion 20, respectively. Such notches 25 and 26 are each provided with a lower laterally bent lip indicated at 27 and 28, which restricts the lower open end of each notch. Such lips are designed to snap under the bulb of the tee.

The vertical portion 14 of the clip is essentially in a common vertical plane and includes a center tab 32 which is in such plane. The vertical portion also includes two lateral tabs 33 and 34 which are offset rather sharply at their upper ends as indicated at 35 and which are interconnected at the bottom as seen at 36. Such offset tabs include barbs 38 struck from the inner edges thereof which project upwardly at an inclined angle toward the opposed surface of the planar tab 32. As illustrated, three such barbs 38 on each side of the interior of the deflected tabs 33 and 34 may be provided each projecting upwardly toward the planar surface of the tab 32. Both the planar and offset tabs are struck from the vertical portion 14 near their upper end as indicated at 40 so that either may readily manually be spring deflected from their normal position as indicated in FIG. 3.

Figure 6:
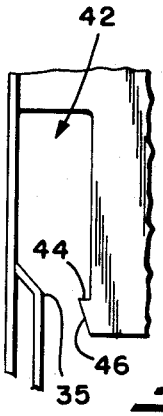
FIG. 6 is an enlarged fragmentary elevation of the wedge notch formed at the corner of the clip between the vertical and horizontal portions.

As seen more clearly in FIG. 3, the major point of deflection 35 of the deflected tabs 33 and 34 partially blocks a slot 42 in the horizontal arm portion 13 at the corner between the horizontal and vertical portions of the clip. The slot 42 includes a bottom lip or shelf indicated at 44 located at the lower end of the outer edge of such slot away from the vertical portion 14. As seen more clearly in FIG. 6, the lip 44 includes an inclined bottom edge 46 serving to guide a bulb of a tee into such slot. The lip also cooperates with the offsets or bends 35 partially to block the lower end of the slot with both snapping under the lower edge of the bulb inserted.

As seen in FIGS. 1 and 3 the parallel but offset portion 19 of the arm portion 13 may include a hole 52. Such hole may be for a sheet metal screw or pop rivet to secure the arm 13 to the bulb of the tee. The hole and such fastener would normally be used only where a more positive engagement is required such as at a butt splice. Because not all bulb sizes are the same, the edges 54 and 55 of the notches 25 and 26 may be slit horizontally as indicated at 56 to form a plurality of tabs 57 which may be bent slightly laterally as indicated at 58 and 59 in FIG. 2. Such tabs bear against the sides of the bulb and may snap under bulbs of various sizes, configurations or height thus preventing slippage or looseness.

Figure 7:
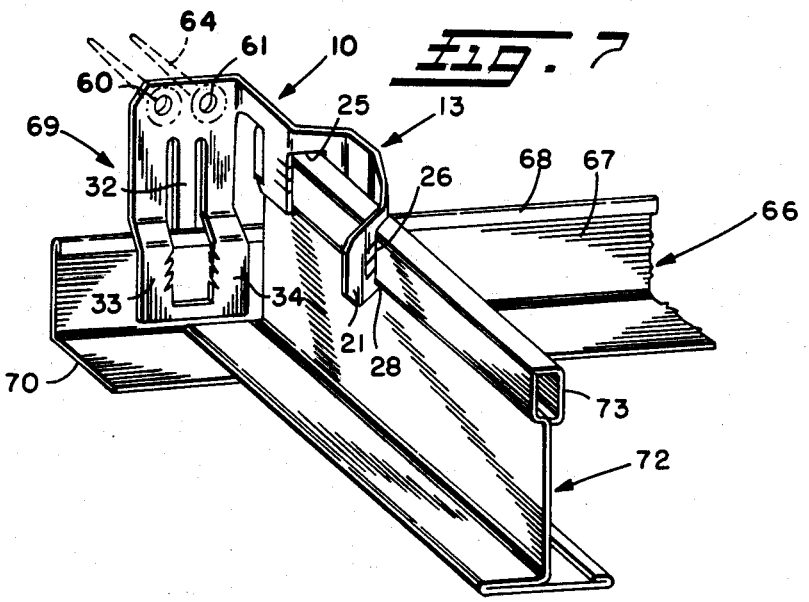
FIG. 7 is a fragmentary perspective view illustrating the clip securing together an edge molding or angle and a main or cross-tee.

It is also noted that the vertical portion of the clip indicated at 14 may be provided with two holes seen at 60 and 61. This permits the clip to be suspended by hanger wires or fasteners such as seen in FIG. 7 at 64 driven into the wall to support the clip of the present invention against the wall at any desired location. When the clip is thus secured to a wall, the wall molding angle 66 which includes upturned leg 67 having a hemmed folded edge 68 is then inserted into the lower portion of the vertical portion of the clip by positioning the upturned leg between the center tab 32 which is against the wall 69 and the outwardly offset tabs 33 and 34 with the hemmed edge and interior wall of the upturned leg of the angle being caught by the barbs 38. It is noted that the clip will accommodate various size wall molding legs and that the wall molding may be inserted in the clip to the extent desired to bring the bottom leg 70 to the desired elevation. It is noted that the wall molding may be vertically or horizontally adjusted from its grasped position simply by springing the offset tabs 33 and 34 away from the upturned leg 67 of the angle 66. In this manner the wall molding may readily be supported by the clip 10. It will of course be appreciated that the clip may also be supported on the ceiling or the wall by tie wires extending through one or both holes 60 and 61.

If the position of the clip 10 as seen in FIG. 7 has been randomly selected simply to support the wall molding at a given elevation, the horizontal portion 13 of the clip may go unused. In this manner the clip may be used solely to support a wall molding. If the location of the clip has been carefully preselected, then the horizontal portion 13 may be used to support a main or cross tee indicated at 72. A tee as indicated at 72 may readily be inserted in the horizontal portion by pressure on the tab 21 which enlarges the transverse dimension of the slot with respect to the longitudinal axis of the tee enabling the bulb 73 of the tee to be inserted into such notches. Release of the pressure on the tab 21 then causes the edges of the slots or notches 25 and 26 to bite into the sidewalls of the bulb securing the tee 72 in place. Also, the lower lips 27 and 28 of such notches will engage beneath the opposite lower shoulders of the bulb ensuring that the bulb is secured. The tee of course can be horizontally adjusted simply by again applying finger pressure to the tab 21.

It will further be appreciated that as long as the clip is not attached to the wall, it may be horizontally adjusted along the wall molding 66 simply by deflecting the tabs 33 and 34 away from the wall. Then, when both the clip and the tee are in the proper position along the wall molding, the clip may be secured to the wall.

Figure 8:
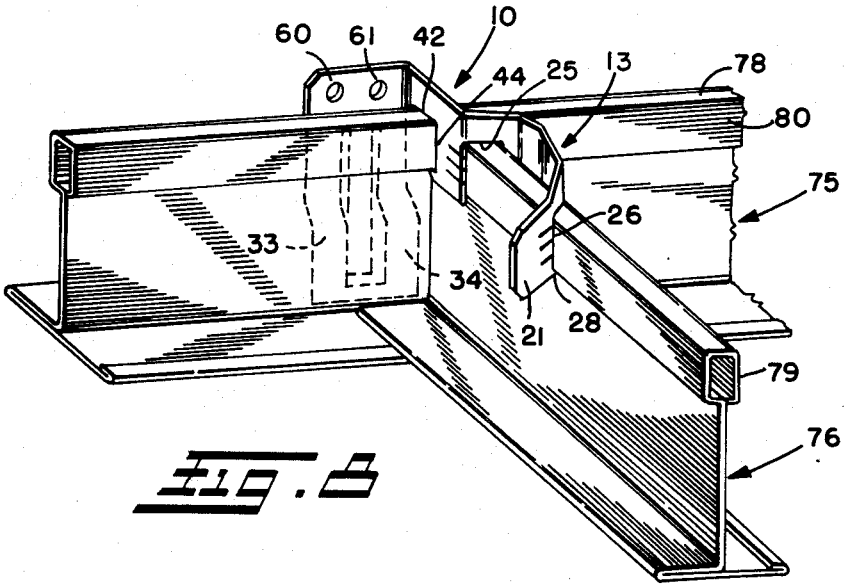
FIG. 8 is a similar view illustrating the clip connecting a main and cross-tee.

FIG. 8 illustrates a typical tee-to-tee connection. The tee indicated at 75 may be considered the main tee while the tee indicated at 76 may be considered the cross tee. The clip may initially be inserted on the main tee 75 by forcing the bulb 78 into the wedge hole 42. The offset tabs 33 and 34 are deflected out of the way to permit the bulb 78 to enter the wedge hole and when properly seated, the serrated edge 44 bites into the sidewall of the bulb as indicated at 80 and the offset tabs snap beneath the opposite lower shoulder of the bulb securing the clip 10 to the tee 75. The cross tee 76 may then be inserted in the horizontal section 13 of the clip in the same manner as in FIG. 7. Again horizontal adjustment of both tees with respect to the clip is readily possible. It is noted that when assembled, the lower flanges or heads indicated at 81 and 82 of the respective tees are superjacent each other. In any event the clip can accommodate various size wall moldings and various height cross tees and main tees and horizontal adjustment is readily obtainable. After proper adjustment, the clips may readily be secured to tie wires or to the wall.

Although the invention has been shown and described with respect to certain preferred embodiments, it is obvious that equivalent alterations and modifications will occur to other skilled in the art upon the reading and understanding of this specification. The present invention includes all such equivalent alterations and modifications, and is limited only by the scope of the following claims.

We claim:

1. A spring steel fastener for suspended ceiling grids including tee bars, angles and the like, comprising a horizontal portion and a vertical portion connected to said horizontal portion at one end thereof, said vertical portion being offset at an angle to said horizontal portion, said horizontal portion including means for resiliently gripping and releasing the bulb of the stem of a tee bar, said vertical portion including means for gripping and releasing the upturned edge of an angle and means for gripping and releasing the bulb of a stem of a tee bar, said vertical portion being essentially planar and including a downwardly projecting spring tab in such plane, and a downwardly extending spring tab offset from such plane with the upturned edge of such angle adapted to be grasped therebetween, and a notch in said horizontal portion at its connection to said vertical portion adapted to accomodate the bulb portion of said second mentioned tee bar, the upper end of said offset tab partially blocking the opening of said notch and snapping beneath the shoulder of such bulb portion when inserted in such notch.

2. A fastener as set forth in claim 1 including an inwardly projecting lip on one vertical edge of such notch.

3. A fastener as set forth in claim 2 wherein said lip has an inclined lower edge.

4. A spring steel fastener for suspended ceiling grids including tee bars, angles, and the like comprising a horizontal portion and a vertical portion connected to said horizontal portion at one end thereof, said vertical portion being offset at an angle to said horizontal portion, said horizontal portion including means for resiliently gripping and releasing the bulb of the stem of a tee bar, said vertical portion including means for gripping and releasing the upturned edge of an angle and means for gripping and releasing the bulb of a stem of a tee bar, said vertical portion being essentially planar and including a downwardly projecting spring tab in such plane, a downwardly extending spring tab offset from such plane with the upturned edge of such angle adapted to be grasped therebetween, and upturned barbs on the edge of said offset tab adapted to engage and grip the upturned edg eof the angle, said offset tab comprising two tabs on each edge of the vertical portion which are interconnected at the bottom of the vertical portion.

5. A spring steel fastener for suspended ceiling grids including tee bars, angles, and the like comprising a horizontal portion and a vertical portion connected to said horizontal portion at one end thereof, said vertical portion being offset at an angle to said horizontal portion, said horizontal portion including means for resiliently gripping and releasing the bulb of the stem of a tee bar, said vertical portion including means for gripping and releasing the upturned edge of an angle and means for gripping and releasing the bulb of a stem of a tee bar, said vertical portion including a spring tab offset from said vertical portion in the same direction as such horizontal portion, and said horizontal portion including a downwardly extending notch, the opening of which is partially blocked by said offset spring tab whereby when such offset tab is deflected the bulb of such second-mentioned tee bar may be positioned in such notch and grasped when such offset tab is released.

6. A spring steel fastener for suspended ceiling grids including tee bars, angles, and the like comprising a horizontal portion and a vertical portion connected to said horizontal portion at one end thereof, said vertical portion being offset at an angle to said horizontal portion, said horizontal portion including means for resiliently gripping and releasing the bulb of the stem of a tee bar, and said vertical portion including means for gripping and releasing the upturned edge of an angle and means for gripping and releasing the bulb of a stem of a tee bar, said horizontal portion comprising an arm in a series of vertical planes of lesser height than said vertical portion and including an offset portion which includes notches in the lower edges thereof adapted to accomodate the bulb of such first mentioned tee bar when the offset portion is compressed and to grip such bulb portion when released.

7. A fastener as set forth in claim 6 wherein said notches each include a lip on the lower edge thereof adapted to fit beneath such bulb.

8. A fastener as set forth in claim 6 including a tab formed on one edge of each notch to engage the side of a bulb inserted therein.

9. A fastener as set forth in claim 6 including a hole in said horizontal portion to facilitate fasteneing such portion to the bulb of a tee.

10. A fastener as set forth in claim 6 including a tab on the end of said arm to facilitate the compression of said offset portion.

11. A spring steel fastener for suspended ceiling grids including tee bars, angles and the like comprising at least one horizontal portion and vertical portion, said vertical portion including a planar tab and an offset tab offset in the direction of the horizontal portion, and a downwardly extending notch in said horizontal portion adjacent the vertical portion, the upwardly extending leg of such angles being secured between said planar and offset tab, or the bulb of a tee being positioned in said notch and caught by the offset of the tab offset in the direction of the horizontal portion.

12. A fastener as set forth in claim 11 including upturned barbs on the edge of said offset tab adapted to engage and grip the upturned edge of the angle.

13. A fastener as set forth in claim 12 wherein the upper end of said offset tab partially blocks the opening of said notch and snaps beneath the shoulder of such bulb portion when inserted in the notch.

14. A fastener as set forth in claim 13 wherein said offset tab comprises two tabs on each edge of the vertical portion which are interconnected at the bottom of the vertical portion.

15. A fastener as set forth in claim 11 wherein said at least one of said horizontal portions includes an arm in a series of vertical planes of lesser height than said vertical portion and which includes an offset portion which includes notches in the lower edges thereof adapted to accommodate the bulb of a tee bar when the offset portion is compressed and to grip such bulb portion when released.

16. A fastener as set forth in claim 15 wherein said notches in the offset portion of said arm each includes a lip on the lower edge thereof adapted to fit beneath the bulb of such last mentioned tee.

17. A fastener as set forth in claim 16 including a tab on the end of said arm to facilitate the compression of said offset portion.

* * * * *